US007186140B2

(12) United States Patent
Chen

(10) Patent No.: US 7,186,140 B2
(45) Date of Patent: Mar. 6, 2007

(54) SCSI PORT WITH STACKED CONNECTORS

(75) Inventor: Chien-Chiu Chen, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/411,793

(22) Filed: Apr. 27, 2006

(65) Prior Publication Data

US 2007/0010131 A1 Jan. 11, 2007

(30) Foreign Application Priority Data

Jul. 8, 2005 (TW) ..... 94211590 U

(51) Int. Cl.
*H01R 13/66* (2006.01)
*H01R 13/648* (2006.01)

(52) U.S. Cl. ..... 439/541.5

(58) Field of Classification Search ..... 439/95, 439/108, 541.5, 608, 609, 620.06, 620.12, 439/620.15, 701
See application file for complete search history.

(56) References Cited

U.S. PATENT DOCUMENTS 5,104,341 A * 4/1992 Gilissen et al. ..... 439/608
6,641,438 B1 * 11/2003 Billman ..... 439/608
6,848,944 B2 * 2/2005 Evans ..... 439/608
7,101,225 B2 * 9/2006 Kohler ..... 439/608
2002/0072276 A1 * 6/2002 Lewis ..... 439/701

* cited by examiner

*Primary Examiner*—James R. Harvey
(74) *Attorney, Agent, or Firm*—Troxell Law Office PLLC

(57) ABSTRACT

A SCSI port 8 includes a conductor assembly 7 including first plates 3A including first and second conductors 6A and 61 at two adjacent sides, mated first plates 3B including first and second conductors 6B and 61 at two adjacent sides, the first plates 3A matingly, alternately assembled with the mated first plates 3B, and two second plates 4 mounted on both ends of the assembled plates 3A and 3B. The first conductors 6A and 6B are formed as two groups of conductor members 62, each group having two rows of the conductor members 62. The conductor members 62 are lockingly inserted into apertures 20 of insulative upper and lower conductor housings 2 which are mounted in an alloy frame 1 and have two projected portions being covered by the frame 1. Mounting legs 5 have one ends in the frame 1 and the other ends in a PCB.

6 Claims, 5 Drawing Sheets

SCSI PORT WITH STACKED CONNECTORS

BACKGROUND OF THE INVENTION

1. Field of Invention

The present invention relates to electrical connectors and more particularly to a SCSI (Small Computer Systems Interface) port having two connectors, one of which mounted over the other for saving space and obtaining other advantageous purposes.

2. Description of Related Art

SCSI connectors are widely used to interconnect a computer and a peripheral. Typically, a SCSI port mounted on a printed circuit board (PCB) has a single connector. Also, it is understood that only a limited space is available on a PCB for mounting an increasing number of SCSI ports. Thus, how to save space is an important issue to consider in SCSI connector design for PCB application. Moreover, prior SCSI ports are comprised of a great number of components including brackets, housings, insulative body, mounting legs, etc., resulting in an increased difficulty of assembly and low durability. Thus, the need for improvement still exists.

SUMMARY OF THE INVENTION

It is therefore an object of the present invention to provide a SCSI port comprising an alloy frame, insulative upper and lower conductor housings each including a plurality of rows of apertures, a conductor assembly, and a plurality of mounting legs wherein the conductor assembly comprises a plurality of first plates including a plurality of first A-type conductors at one side and a plurality of second conductors having a right leg at an adjacent side, a plurality of mated first plates including a plurality of first B-type conductors at one side and a plurality of second conductors having a left leg at an adjacent side, the first plates matingly, alternately assembled with the mated first plates, and two second plates mounted on both ends of the assembled first plates A and mated first plates; the first A-type conductors and the first B-type conductors are formed as two groups of conductor members, each group having two rows of the conductor members; the conductor members are lockingly inserted into the apertures of the insulative upper and lower conductor housings; the insulative upper and lower conductor housings are mounted in the frame and have two projected portions being covered by the frame; and the mounting legs have one ends mounted in the frame and the other ends mounted in a PCB.

In an aspect of the present invention there is provided the U-shaped frame is an integral component and comprises a mating face, upper and lower insulative rectangular shield cases for covering the insulative upper and lower conductor housings, and two side arms extended from both ends of the mating face.

In another aspect of the present invention there is provided on either side of the mating face there are provided upper and lower indentations each having a through hole, and on a back of the mating face there are provided a plurality of parallel first shelves, on an inner surface of either arm there are provided a plurality of parallel second shelves each having a ramp on its open end, and upper and lower inwardly projected flats, and on an outer surface of either arm there is provided a lower outwardly projected plane which has its bottom at the same elevation as a bottom of the lower flat, the plane including a plurality of bottom slots.

In yet another aspect of the present invention there is provided on a front surface of the mating face there are provided with upper and lower insulative rectangular shield cases.

In a further aspect of the present invention there is provided each of the first plate, the mated first plate, and the second plate is of square and further comprises a cylindrical tab proximate its one corner, and a hole proximate its diagonal corner; and wherein the tab has a diameter substantially the same as that of the hole such that one first plate and one adjacent mated first plate are adapted to fastened together by fitting the tab of one first plate into the hole of the adjacent mated first plate and by fitting the tab of the adjacent mated first plate into the hole of one first plate.

In yet further aspect of the present invention there is provided the right leg of the first plate is spaced from the left leg of the mated first plate by a predetermined distance.

The above and other objects, features and advantages of the present invention will become apparent from the following detailed description taken with the accompanying drawings.

DETAILED DESCRIPTION OF THE INVENTION

Figure 1:
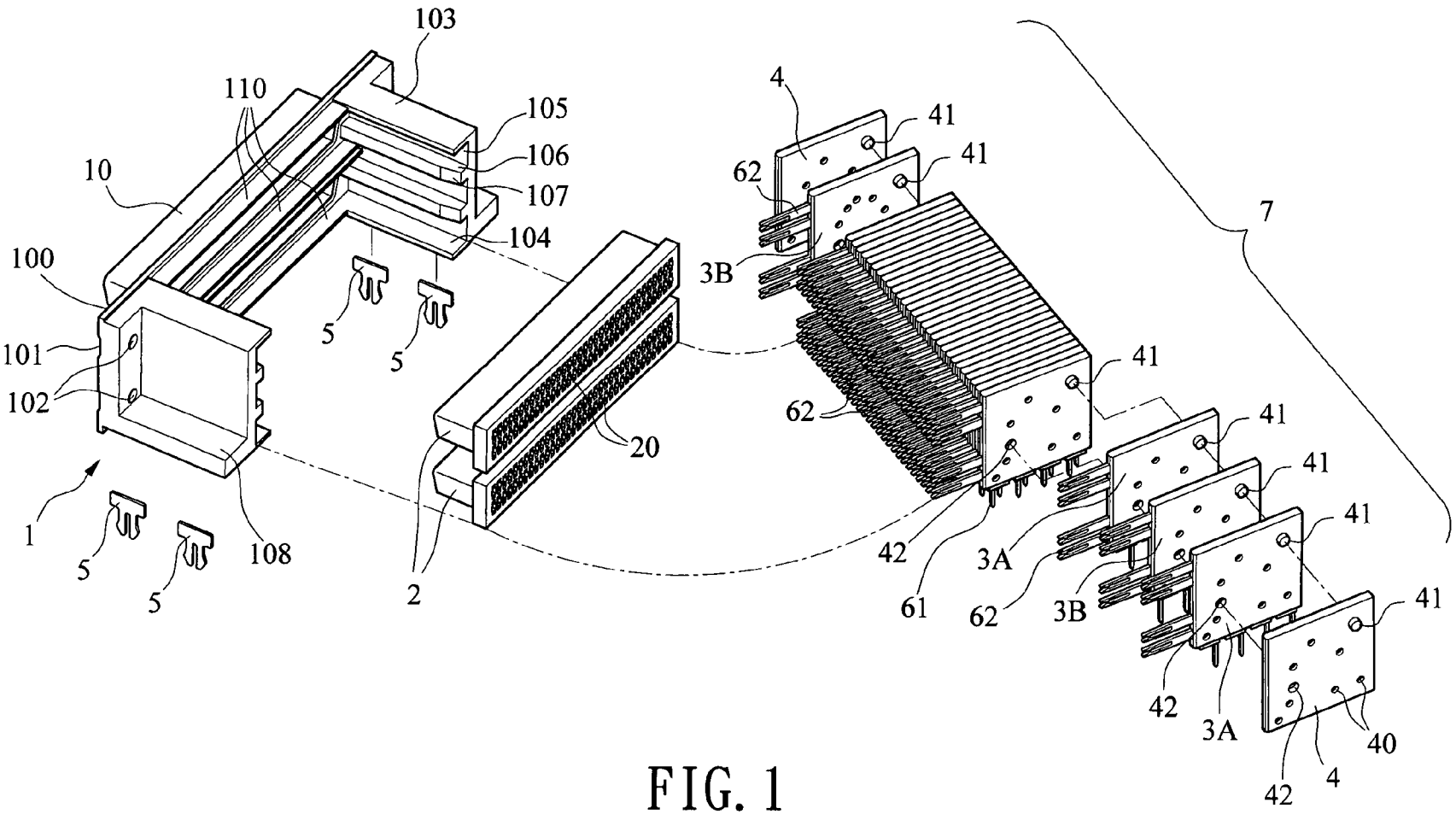
FIG. 1 is an exploded perspective view of a preferred embodiment of SCSI port according to the invention.
Figure 2:
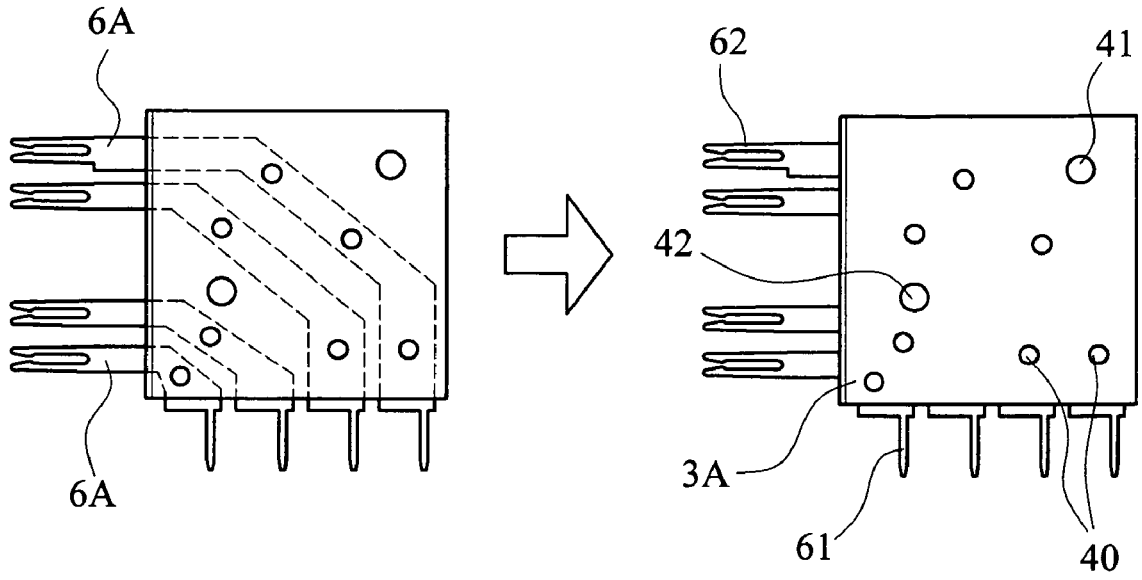
FIG. 2 is a side elevation schematically depicting a forming of first plate.
Figure 3:
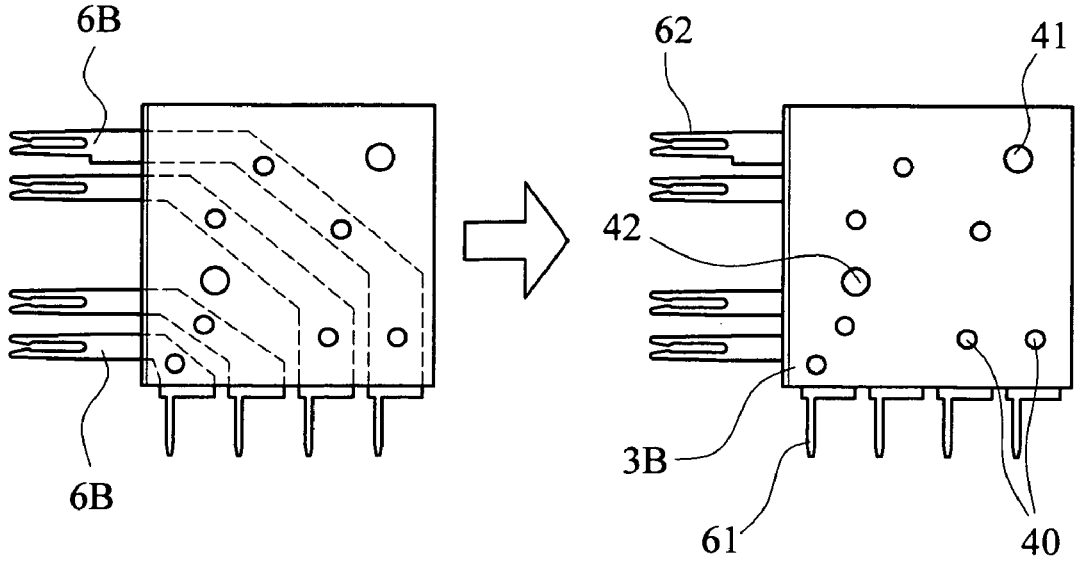
FIG. 3 is a side elevation schematically depicting a forming of mated first plate.
Figure 4:
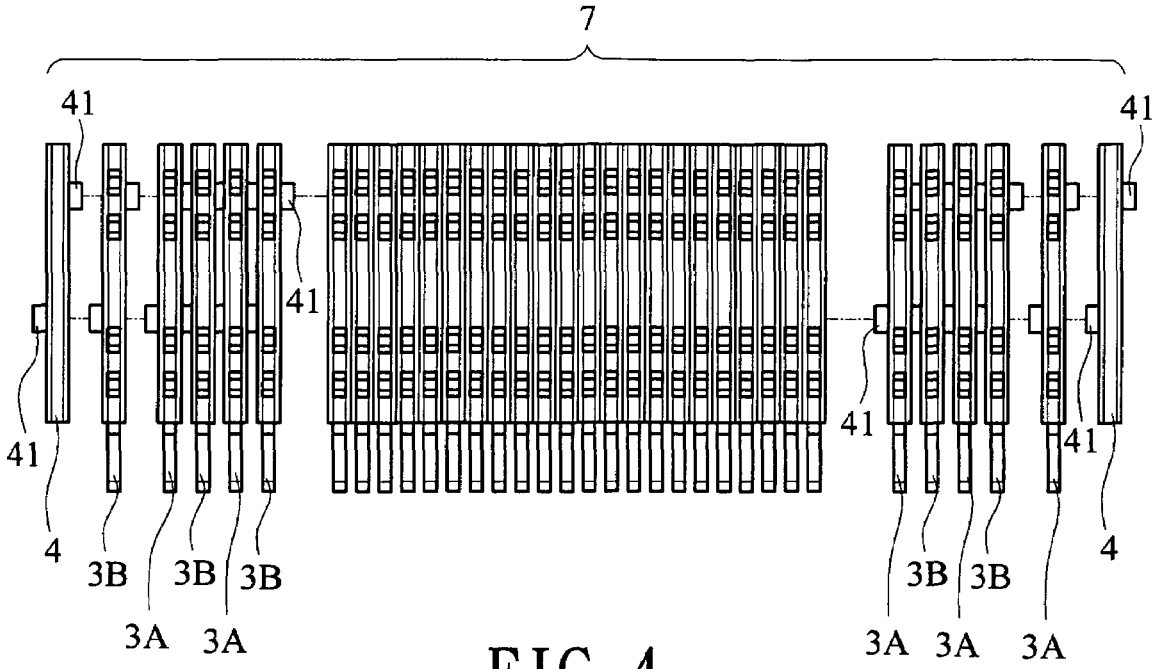
FIG. 4 is a top plan view schematically depicting a forming of conductor assembly.

Referring to FIGS. 1 to 7, a SCSI port 8 in accordance with a preferred embodiment of the invention comprises an alloy frame 1, insulative upper and lower conductor housings 2, a conductor assembly 7, and a plurality of mounting legs 5. Each component is discussed in detailed below.

The U-shaped frame 1 is an integral component and comprises a mating face 100, upper and lower insulative rectangular shield cases 10 on a front surface of the mating face 100, and two side arms 105 extended from both ends of the mating face 100. On either side of the mating face 100, there are provided upper and lower indentations 101 each having a through hole 102. A fastener is adapted to drive through the hole 102 to secure the port 8 to an external member. On the back of the mating face 100 there are provided a plurality of parallel first shelves 110. On an inner surface of either arm 105 there are provided a plurality of parallel second shelves 106 each having a ramp 107 on its open end, and upper and lower inwardly projected flats 103 and 104. On an outer surface of either arm 105 there is provided a lower outwardly projected plane 108 which has its bottom at the same elevation as bottom of the lower flat 104. A plurality of slots (two are shown) 111 are provided on the bottom of the plane 108.

Each of the insulative upper and lower conductor housings 2 comprises a plurality of (two are shown) rows of apertures 20. The conductor assembly 7 comprises a plurality of first plates 3A and a plurality of mated first plates 3B alternately packed with the first plates 3A. In detail, the first plate 3A is formed with a plurality of A-type conductors 6A at one side and a plurality of second conductors 61 having a right leg at an adjacent side. The mated first plate 3B is formed with a plurality of B-type conductors 6B at one side and a plurality of second conductors 61 having a left leg at an adjacent side. Each of the first plate 3A and the mated first plate 3B is of square and comprises a short, cylindrical tab 41 proximate one corner of the first plate 3A (or mated first plate 3B) and a through hole 42 proximate a diagonal corner of the first plate 3A (or mated first plate 3B) in which the tab 41 has a diameter substantially the same as that of the through hole 42. Thus, one first plate 3A and an adjacent mated first plate 3B can be closely fastened together by snugly fitting the tab 41 of the first plate 3A into the through hole 42 of the mated first plate 3B and by snugly fitting the tab 41 of the mated first plate 3B into the through hole 42 of the first plate 3A. In such a manner, a complete conductor assembly 7 is formed.

Figure 5:
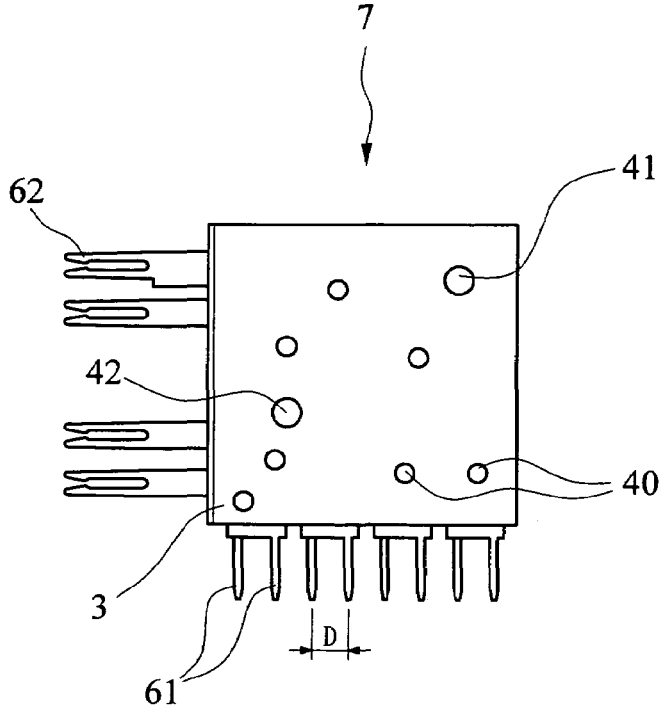
FIG. 5 is a a side elevation of the conductor assembly in FIG. 4.
Figure 6:
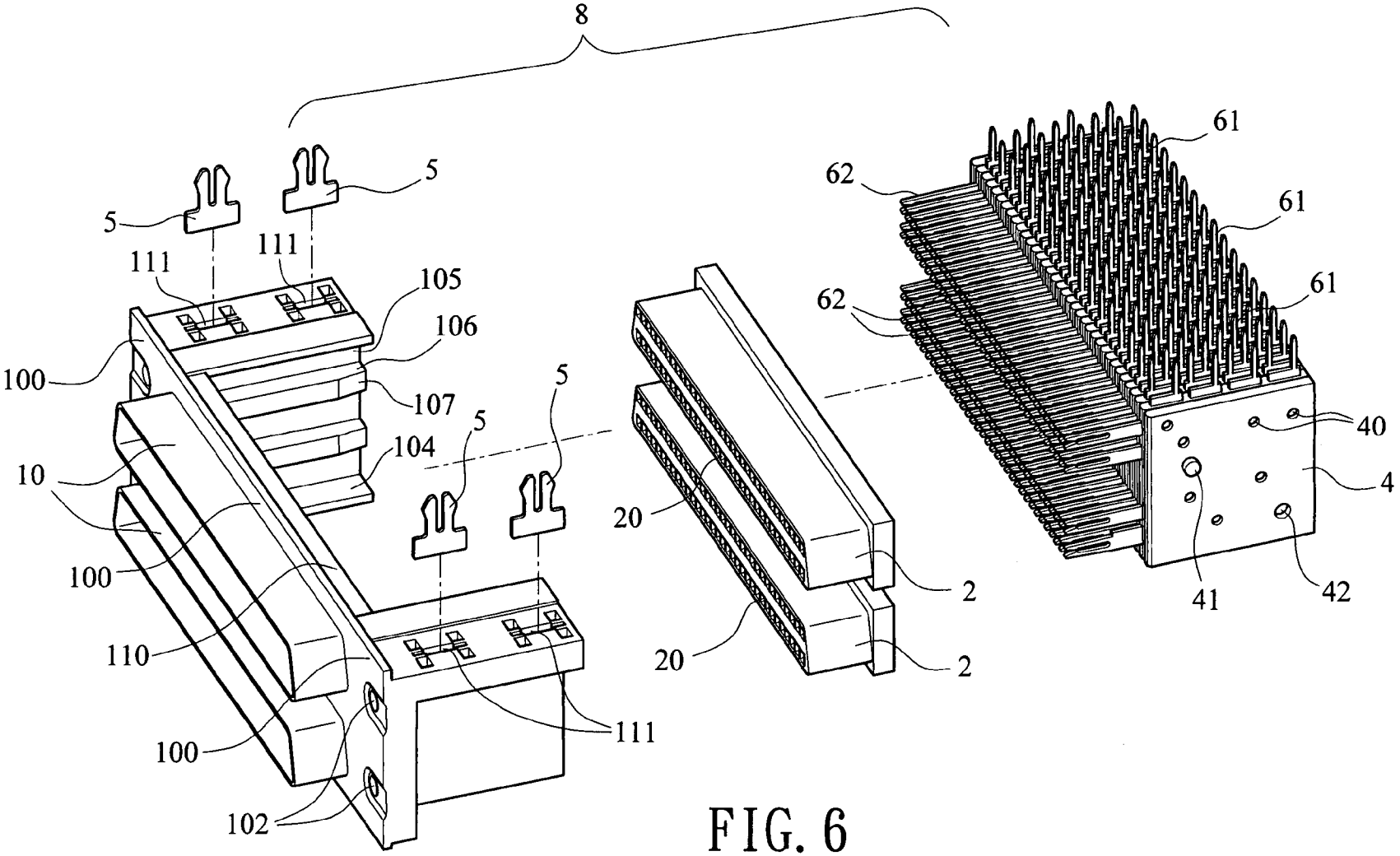
FIG. 6 is an exploded perspective view of the SCSI port in FIG. 1 from an opposite angle.
Figure 7:
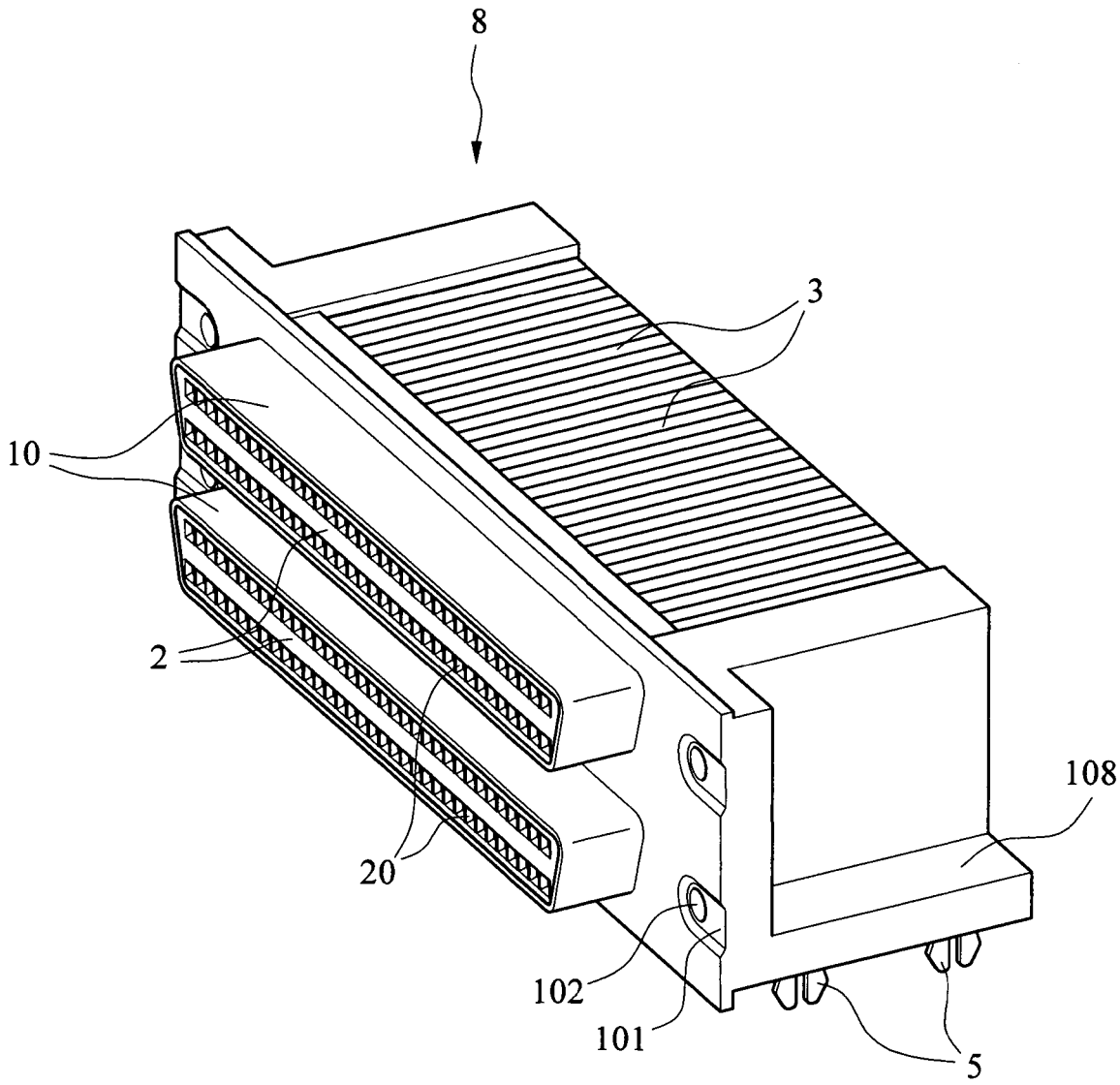
FIG. 7 is a perspective view of the assembled SCSI port.

As shown in FIG. 5, there is a distance D between two legs of a first conductor 61. The distance D is sufficient to prevent a potential short-circuit from occurring when the port 8 is mounted on a PCB (not shown) by soldering. Two second plates 4 of square are provided and the second plate 4 is identical to either the first plate 3A or the mated first plate 3B, except that the second plate 4 has no conductors provided thereon. Also, the second plate 4 is mounted on either end of the conductor assembly 7 in a manner the same as that described in the previous paragraph. A plurality of conductor members 62 consisting of the A-type conductors 6A and the B-type conductors 6B arranged in two groups each having two rows are inserted into the apertures 20 of the insulative upper and lower conductor housings 2 for fastening the conductor assembly 7 and the insulative upper and lower conductor housings 2 together. Next, mount the insulative upper and lower conductor housings 2 in the frame 1 as being supported by the first and second shelves 110 and 106 and two projected portions of the insulative upper and lower conductor housings 2 being fitted in and covered by the upper and lower insulative rectangular shield cases 10. Finally, insert the mounting legs 5 in the slots 111 and mount the mounting legs 5 in the PCB. The port 8 is thus mounted.

The invention has the following advantages including easy assembly, high yield, durability, and replacement of any malfunctioned first plates 3A or mated first plates 3B being possible.

While the invention herein disclosed has been described by means of specific embodiments, numerous modifications and variations could be made thereto by those skilled in the art without departing from the scope and spirit of the invention set forth in the claims.

What is claimed is:

1. A SCSI port comprising an alloy frame 1, insulative upper and lower conductor housings 2 each including a plurality of rows of apertures 20, a conductor assembly 7, and a plurality of mounting legs 5 wherein:

the conductor assembly 7 includes a plurality of first plates 3A including a plurality of first conductors 6A at one side and a plurality of second conductors 61 having a right leg at an adjacent side, a plurality of mated first plates 3B including a plurality of mated first conductors 6B at one side and a plurality of mated second conductors 61 having a left leg at an adjacent side, the first plates 3A matingly, alternately assembled with the mated first plates 3B, and two second plates 4 mounted on both ends of the assembled first plates 3A and mated first plates 3B;

the mated first conductors 6A and the first conductors 6B are formed as two groups of conductor members 62, each group having two rows of the conductor members 62;

the conductor members 62 are lockingly inserted into the apertures 20 of the insulative upper and lower conductor housings 2;

the insulative upper and lower conductor housings 2 are mounted in the frame 1 and have two projected portions being covered by the frame 1; and the mounting legs 5 have one ends mounted in the frame 1 and the other ends mounted in a printed circuit board (PCB).

2. The SCSI port of claim 1, wherein the frame 1 formed in integrally into a U-shape and comprises a mating face 100, upper and lower insulative rectangular shield cases 10 for covering the insulative upper and lower conductor housings 2, and two side arms 105 extended from both ends of the mating face 100.

3. The SCSI port of claim 2, wherein on either side of the mating face 100 there are provided upper and lower indentations 101 each having a through hole 102, and on a back of the mating face 100 there are provided a plurality of parallel first shelves 110, on an inner surface of either arm 105 there are provided a plurality of parallel second shelves 106 each having a ramp 107 on its open end, and upper and lower inwardly projected flats 103 and 104, and on an outer surface of either arm 105 there is provided a lower outwardly projected plane 108 which has its bottom at the same elevation as a bottom of the lower flat 104, the plane 108 including a plurality of bottom slots 111.

4. The SCSI port of claim 2, wherein on a front surface of the mating face 100 there are provided with the upper and lower insulative rectangular shield cases 10.

5. The SCSI port of claim 1, wherein each of the first plate 3A, the mated first plate 3B, and the second plate 4 is of square and further comprises a cylindrical tab 41 proximate its one corner, and a through hole 42 proximate its diagonal corner; and wherein the tab 41 has a diameter substantially the same as that of the through hole 42 such that one first plate 3A and one adjacent mated first plate 3B are adapted to fastened together by fitting the tab 41 of one first plate 3A into the through hole 42 of the adjacent mated first plate 3B and by fitting the tab 41 of the adjacent mated first plate 3B into the through hole 42 of one first plate 3A.

6. The SCSI port of claim 1, wherein the right leg of the first plate 3A is spaced from the left leg of the mated first plate 3B by a predetermined distance D.

* * * * *